US007733285B2

(12) United States Patent
Gainey et al.

(10) Patent No.: US 7,733,285 B2
(45) Date of Patent: Jun. 8, 2010

(54) INTEGRATED, CLOSELY SPACED, HIGH ISOLATION, PRINTED DIPOLES

(75) Inventors: Kenneth M. Gainey, Satellite Beach, FL (US); Christopher A. Snyder, Melbourne, FL (US); James A. Proctor, Jr., Melbourne Beach, FL (US)

(73) Assignee: QUALCOMM Incorporated, San Diego, CA (US)

( * ) Notice: Subject to any disclaimer, the term of this patent is extended or adjusted under 35 U.S.C. 154(b) by 747 days.

(21) Appl. No.: 11/436,041

(22) Filed: May 18, 2006

(65) Prior Publication Data

US 2006/0262026 A1 Nov. 23, 2006

Related U.S. Application Data

(60) Provisional application No. 60/681,948, filed on May 18, 2005.

(51) Int. Cl.
*H01Q 9/28* (2006.01)
*H01Q 1/38* (2006.01)

(52) U.S. Cl. ..... 343/795; 343/793; 343/700 MS; 343/829; 343/846

(58) Field of Classification Search ..... 343/795
See application file for complete search history.

(56) References Cited

U.S. PATENT DOCUMENTS

| | | | | |
|---|---|---|---|---|
| 5,559,521 | A * | 9/1996 | Evans et al. | 343/700 MS |
| 6,559,810 | B2 * | 5/2003 | McCorkle | 343/795 |
| 2005/0116869 | A1 * | 6/2005 | Siegler et al. | 343/749 |
| 2006/0071861 | A1 * | 4/2006 | Okado | 343/700 MS |

* cited by examiner

*Primary Examiner*—Trinh V Dinh
(74) *Attorney, Agent, or Firm*—Linda G. Gunderson

(57) ABSTRACT

An antenna configuration includes two closely spaced antennas each positioned so as to be orthogonally polarized with respect to the other. The antenna configuration increases antenna isolation and reduces electromagnetic coupling between donor side antenna and repeat side antenna. The antennas include printed dipoles connected to respective transceivers through respective baluns to balance the non-symmetrical portions of the antenna feed paths to reduce unwanted radiation therein. Printed features such as chokes and non-symmetrical and non-parallel structures are preferably included in the ground plane of a multi-layer circuit board to reduce or eliminate circulating ground currents.

24 Claims, 10 Drawing Sheets

INTEGRATED, CLOSELY SPACED, HIGH ISOLATION, PRINTED DIPOLES

CROSS REFERENCE TO RELATED APPLICATIONS

The present invention is related to and claims priority from U.S. Provisional Application No. 60/681,948, entitled "INTEGRATED, CLOSELY SPACED, HIGH ISOLATION, PRINTED DIPOLES," filed May 18, 2005, the contents of which are incorporated herein by reference.

FIELD OF THE INVENTION

The present invention relates generally to wireless communications and more specifically to closely spaced antennas utilizing orthogonal polarization to reduce electromagnetic coupling.

BACKGROUND OF THE INVENTION

In certain circumstances, it becomes necessary to closely position multiple omni directional antennas, such as those used in repeaters, where the antennas for both the donor and subscriber sides of the repeater are placed in close proximity. For example, such closely spaced antennas can be embedded onto low cost printed circuit boards for use in various communications products and systems, such as in the WiDeFi™ TDD based repeater system. It is further desirable for such closely spaced antennas to maintain minimal antenna-to-antenna interaction while maintaining good gain characteristics, to be easily producible in high volume manufacturing using low cost packaging, and to be easy for a user to operate. Further, when the antenna is placed near a reflecting surface, such as a wall, that would otherwise change the free space isolation of the antennas, a mechanism is required to reduce or cancel the effect of the interaction.

Three key problems present themselves when attempting to achieve high isolation between multiple, closely-spaced antennas that are printed on a small PCB board with near omni-directional antenna patterns and that must work in close proximity to unknown structures such as walls, furniture, and the like. The problems are coupling of radiated energy, common mode coupling and multi-path or random coupling of in-band signal energy.

In dealing with the first problem of coupling of radiated energy from one antenna into the receiver section of another, the radiated fields emanating from the antenna structure must be cancelled somehow to increase isolation. The closer the antennas are in physical proximity, the more they will tend to couple energy, which coupling reduces isolation between the antennas. Additional problems can arise when attempting to maintain an omni or semi-omni directional antenna pattern.

Dealing with the second problem of common mode coupling involves a coupling mechanism that is difficult to cancel. Common mode coupling occurs due to a shared ground on a printed circuit board. Voltage perturbations on the ground plane associated with generating and transmitting a signal from one antenna circuit couple into an adjacent antenna circuit either electrically into input circuits through the ground plane or indirectly from energy induced into the ground plane or input circuits by the transmitted signal. The problem of common mode coupling is especially difficult when multiple antennas are integrated together on a very small ground plane.

The third problem of random coupling is often the most difficult coupling mechanism to address. With random coupling, energy from indeterminate reflections or interactions with objects that change the radiation patterns or sources of localized coupling are primarily the result of antenna placement. However, attempting to determine an exact antenna placement that reduces or removes the unwanted components while preserving the desired components and the directionality is not generally successful.

SUMMARY OF THE INVENTION

The present invention overcomes the above noted and other problems by providing an antenna configuration for a repeater in which two closely spaced antennas are orthogonally polarized to increase antenna isolation and reduce electromagnetic coupling. The two antennas may be fed in a balanced configuration to reduce common mode currents. The configuration is provided with a ground structure having various non-parallel and non-symmetrical shapes to reduce circulating currents and ground "hot spots" that can act as additional radiators thereby tending to increase coupling.

Alternatively, or in addition, to reducing shape symmetry and parallelism of the ground structure, an exemplary ground structure is provided with various printed structures that "choke" circulating ground currents by inducing opposite polarity currents that will generate electromagnetic (EM) fields with opposite, and thus canceling, polarities. The configuration may also be rotatable and capable of transmitting a sounding signal. By receiving the sounding signal during antenna rotation, the configuration is provided with feedback, which can be output to a user in the form of, for example, a sounding signal strength indicator or the like, providing information regarding antenna signal reflections to enable the user to directionally or spatially reposition the antenna configuration to maximize antenna operation.

DETAILED DESCRIPTION OF THE INVENTION

Figure 1:
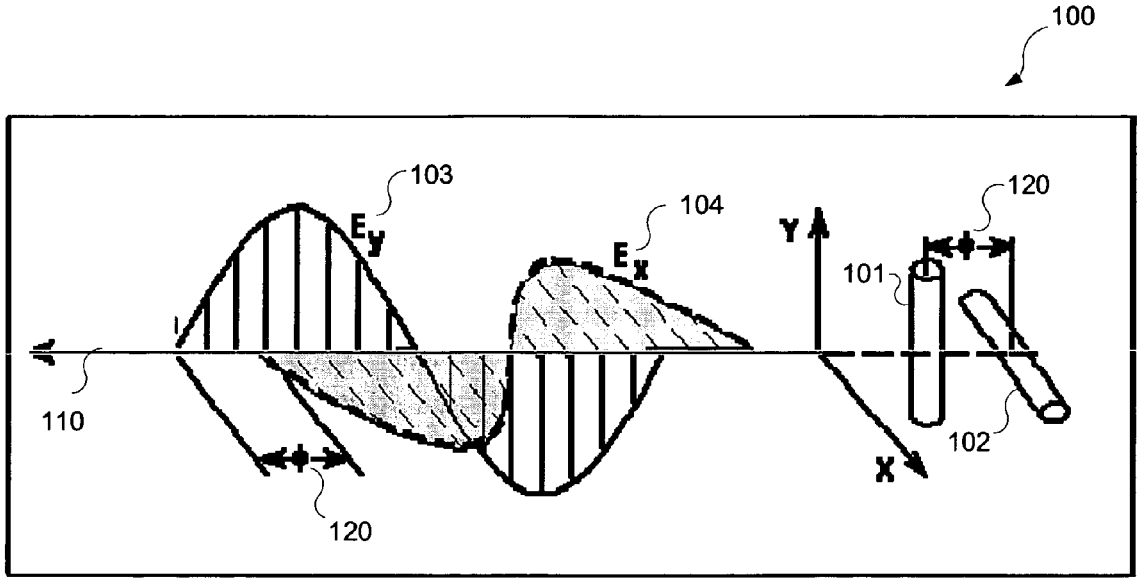
FIG. 1 is a diagram illustrating a horizontally and a vertically polarized dipole antenna with resultant signals having respective horizontal and vertical polarization.

Referring now to the drawings in which like numerals reference like parts, several exemplary embodiments in accordance with the present invention will now be described. To address the above noted problems and other problems, an exemplary antenna configuration is provided where printed dipoles, or dipole elements, are positioned so as to be orthogonally polarized. The interference cause by a signal emanating from one radiating antenna into the adjacent antenna can be cancelled by establishing a polarity or orientation of the adjacent antenna having a natural tendency to cancel the signal energy which is produced with an electromagnetically opposite polarity or orientation from the radiating antenna.

It will be appreciated that the polarization of an antenna relates to the orientation of an electric field of a propagating signal radiated from the antenna and can be determined by the physical structure of the antenna and by its orientation. In contrast, the directionality of the antenna relates to the radiation pattern and is somewhat different from orientation. Polarization is typically referred to in terms of horizontal polarization, vertical polarization, circular polarization, and the like.

An example of polarization can be seen in FIG. 1, where a configuration 100 is shown having a dipole element, or dipole, 101 having a vertical polarization and a dipole element, or dipole, 102 having a horizontal polarization. The dipole 101 and the dipole 102 are separated by a phase angle 120, which will determine the phase difference between a reference signal propagated from each of the dipole 101 and the dipole 102 in a propagation direction 110. It will be appreciated that an exemplary signal $E_y$ 103 transmitted, for example, from the dipole 101, will be vertically polarized; that is, it will have an E field component propagating in a plane that is vertically oriented. Similarly, an exemplary signal $E_x$ 104 transmitted, for example, from the dipole 102, will be horizontally polarized; that is, it will have an E field component propagating in a plane that is horizontally oriented. It will be appreciated that due to the orthogonal relationship between the polarization directions of the dipole 101 and the dipole 102, the likelihood of interference between signals radiated from one of the antennas into the other is low. It will also be appreciated that a signal incident on one of the antennas having a polarization opposite to that of the antenna will not couple well into that antenna. As noted above, some problems arise due to signal reflection, which can change signal polarization. However, by establishing an orthogonal relationship between the polarization of each dipole, maximum cancellation can be achieved even for reflected signals since the polarization can be calculated as the sum of the E field orientations over time relative to an imaginary plane perpendicular to the propagation direction the signal. It should be noted that while the dipole 101 and the dipole 102 are orthogonal, they are separated by a phase 120. In accordance with various exemplary embodiments, the dipole 101 and the dipole 102 are positioned in an orthogonal relationship on the surface of, for example, a printed circuit board, printed wiring board, or the like as will be described in greater detail hereinafter.

Figure 2:
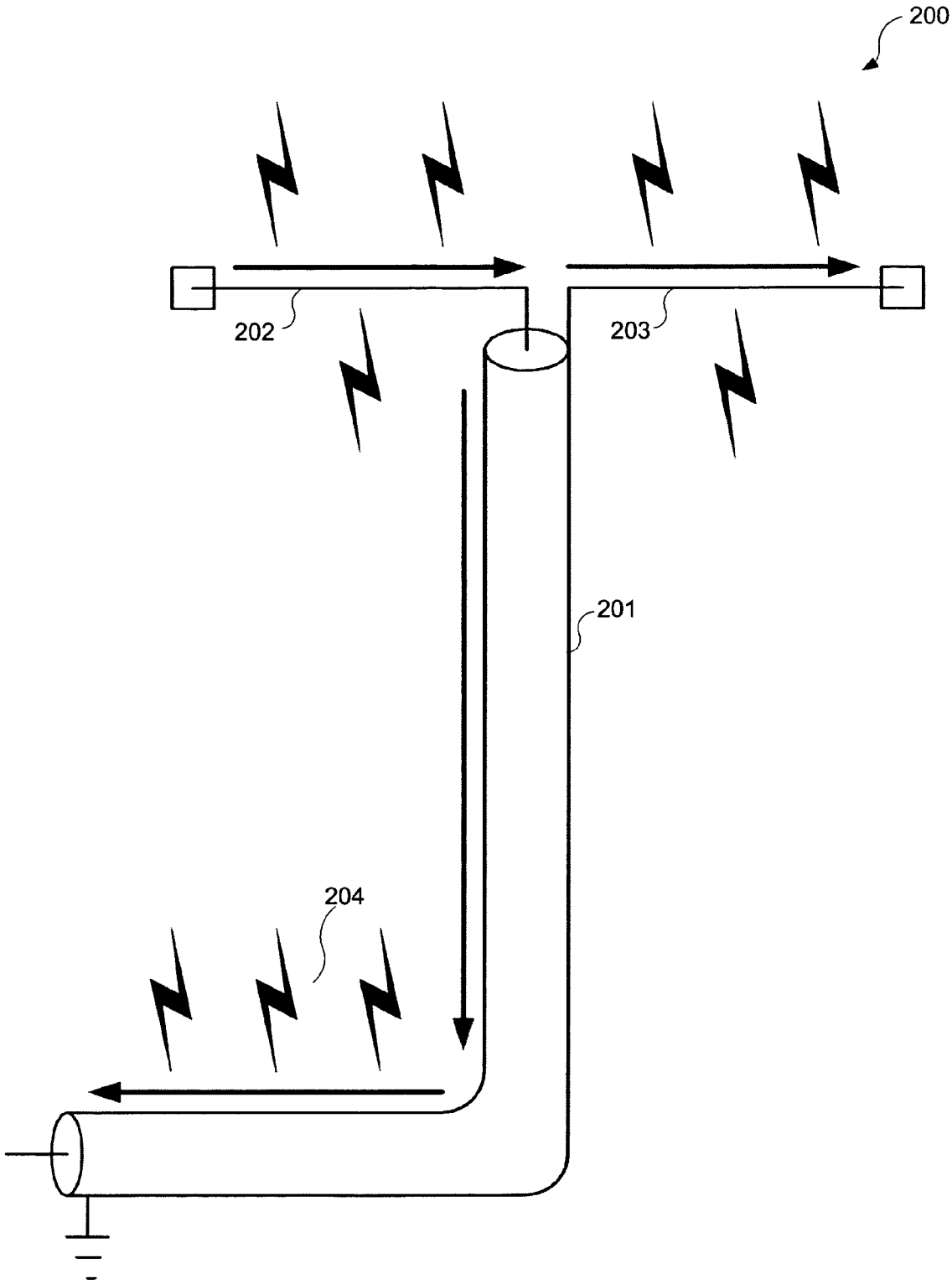
FIG. 2 is a diagram illustrating an exemplary dipole having undesirable circulating currents causing unwanted secondary radiation.
Figure 3:
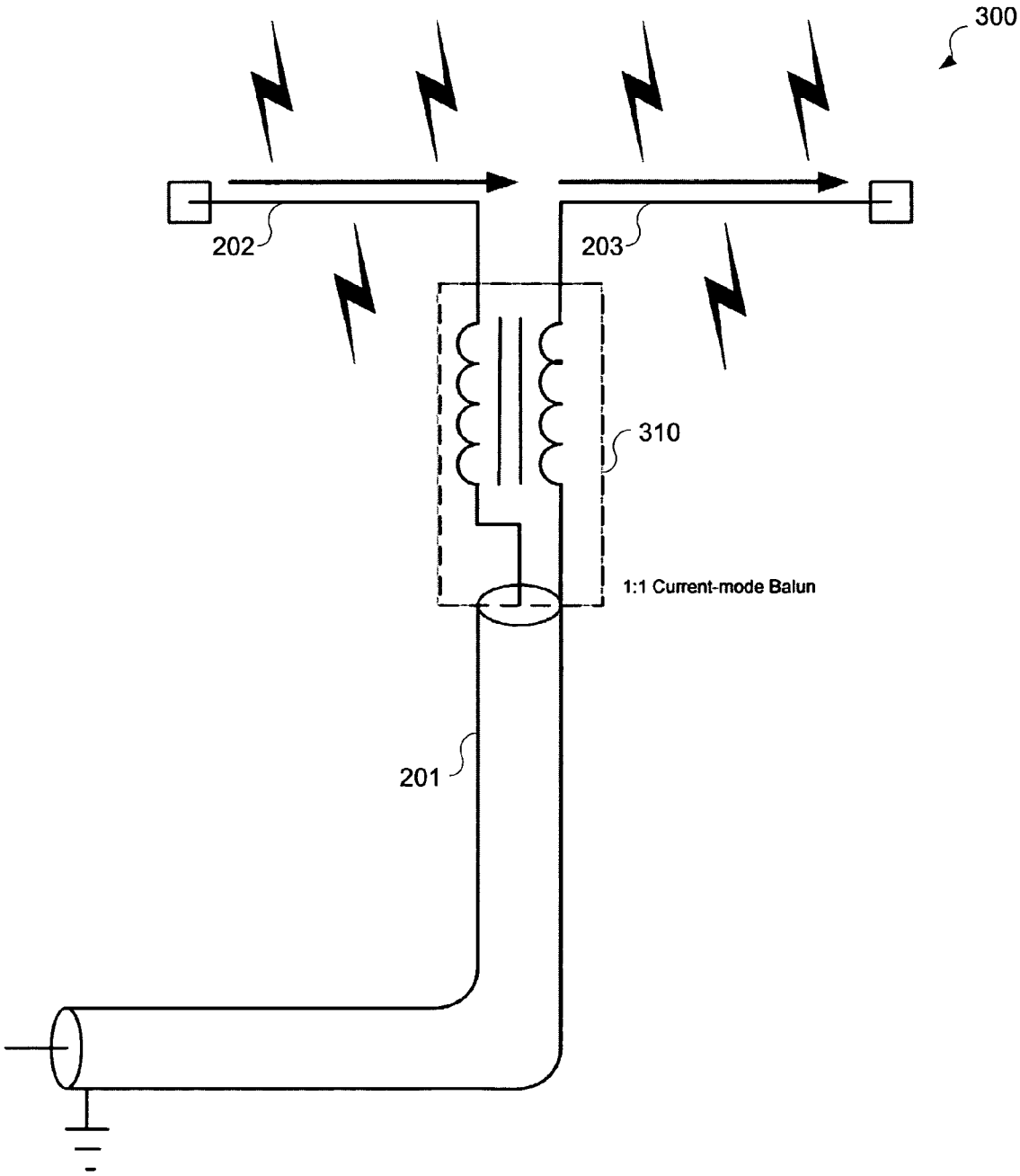
FIG. 3 is a diagram illustrating the exemplary dipole of FIG. 2, having a Balun for eliminating undesirable circulating currents and associated radiation.

In placing exemplary dipoles on the surface of a printed circuit or wiring board, some problems may arise as shown in exemplary configuration 200 in FIG. 2. A dipole antenna 201 is shown, for example, constructed of a coaxial cable with dipole elements 202 and 203. In some instances unbalanced circulating currents in the dipole 201 from impedance mismatches or the like, can cause unwanted radiation 204 to emanate from portions of the dipole other than the radiating dipole elements 202 and 203. The effect is greatest when a balanced configuration such as the symmetrical configuration of the dipole element 202 and the dipole element 203 meet the non-symmetrical or unbalanced portion of the dipole antenna 201. In a circuit board environment, such radiation can cause interference by coupling into input stages of amplifiers, coupling into ground planes, or by coupling into other antenna present on the circuit board. To address the problem, as shown in exemplary configuration 300 in FIG. 3, a balun 310, sometimes referred to as a baluns, or a Marchand Balun, named after Nathan Marchand who described such a configuration in the 1940s for coaxial transmission lines, can be positioned near the dipole elements 202 and 203 of the dipole antenna 201. It will be appreciated that the balun 301 preferably has a precise 180° phase shift, with minimum loss and equal balanced impedances. The balun 301 provides isolation from ground to eliminate parasitic oscillations.

The basic construction/design of the balun 310 consists of two 90° phasing lines that provide the required 180° split. This involves the use of wavelengths in the order of $\lambda/4$ and $\lambda/2$. It will be appreciated that in a general coaxial example, a wire-wound transformer provides a suitable balun. Miniature wirewound transformers are commercially available covering frequencies from low kHz to beyond 2 GHz. Such balun transformers are often configured with a center-tapped secondary winding. When the center tap is grounded, a short circuit is presented to even-mode, or common-mode signals providing isolation and rejection. Differential or odd-mode signals are passed without effect.

As will be described in greater detail hereinafter, wire-wound transformers are expensive and are comparatively unsuitable in form factor for the printed dipoles of the present invention. Thus, the printed or lumped element balun is preferable in practical application. It should be noted the lumped element or printed balun is preferably provided with a center-tapped ground to reject common mode or even mode signals. The Marchand Balun can be adapted for use in a printed circuit configuration to increase isolation and increase noise rejection in the printed dipoles of the present invention, to be described in greater detail hereinafter.

With reference to the previously noted first problem, the interaction of EM fields can be canceled by orienting the printed dipole antennas of the present invention such that the respective polarization of the EM fields of each of the antennas are orthogonal to each other, thereby reducing or canceling any coupling therebetween. To reduce other possible points of radiation from the PCB itself such as radiation which would likely emanate from the ground structure, the shape of physical areas of the printed ground structure in close proximity to the antennas can be adjusted such that the ground structure ordinarily situated in parallel relation to the antenna has perpendicular rectangular structures added such that re-radiation points such as corners are shifted away from antenna structures.

With reference to the previously noted second problem, generalized coupling through the board substrate can be reduced by driving each of the printed dipole antennas of the present invention in a balanced fashion ensuring better isolation. For example, if any portion one signal couples into the other antenna feed structure, it does so as a common mode signal to both traces of the balanced feed structure and is hence canceled. Further, current choke slots can be printed onto the outer edges of the ground layers to reduce any currents that would tend to circulate around the outside of the ground plane between the two antennas. The choke structures cause the circulating currents to flow in opposite directions thereby generating EM fields with in-turn induce counter currents tending to choke off and cancel the original currents.

With reference to the previously noted third problem, several methods including trial and error are possible. However, a preferable approach to dealing with antenna placement is by transmitting a sounding signal from one antenna and receiving or "listening" to the reflections as they propagate back into the other antenna. Based on the arrangement of structures surrounding the antennas, the strength of the signal reflections back into the receiving antenna will be either higher than desired or will be sufficiently low to allow proper system operation. An indication can be provided to a user, either through a visual indicator such as a lamp or an LED, or through a series of LEDs, an external monitoring device, or the like. If the strength of the reflections as indicated by the LEDs is higher than desirable, a user can be directed to move or reposition the antenna until the strength of the reflections are minimized to levels considered to be acceptable. As noted, the feedback to the user could take many forms and the readjustment of the antenna could be in any different direction and any distance.

Figure 4:
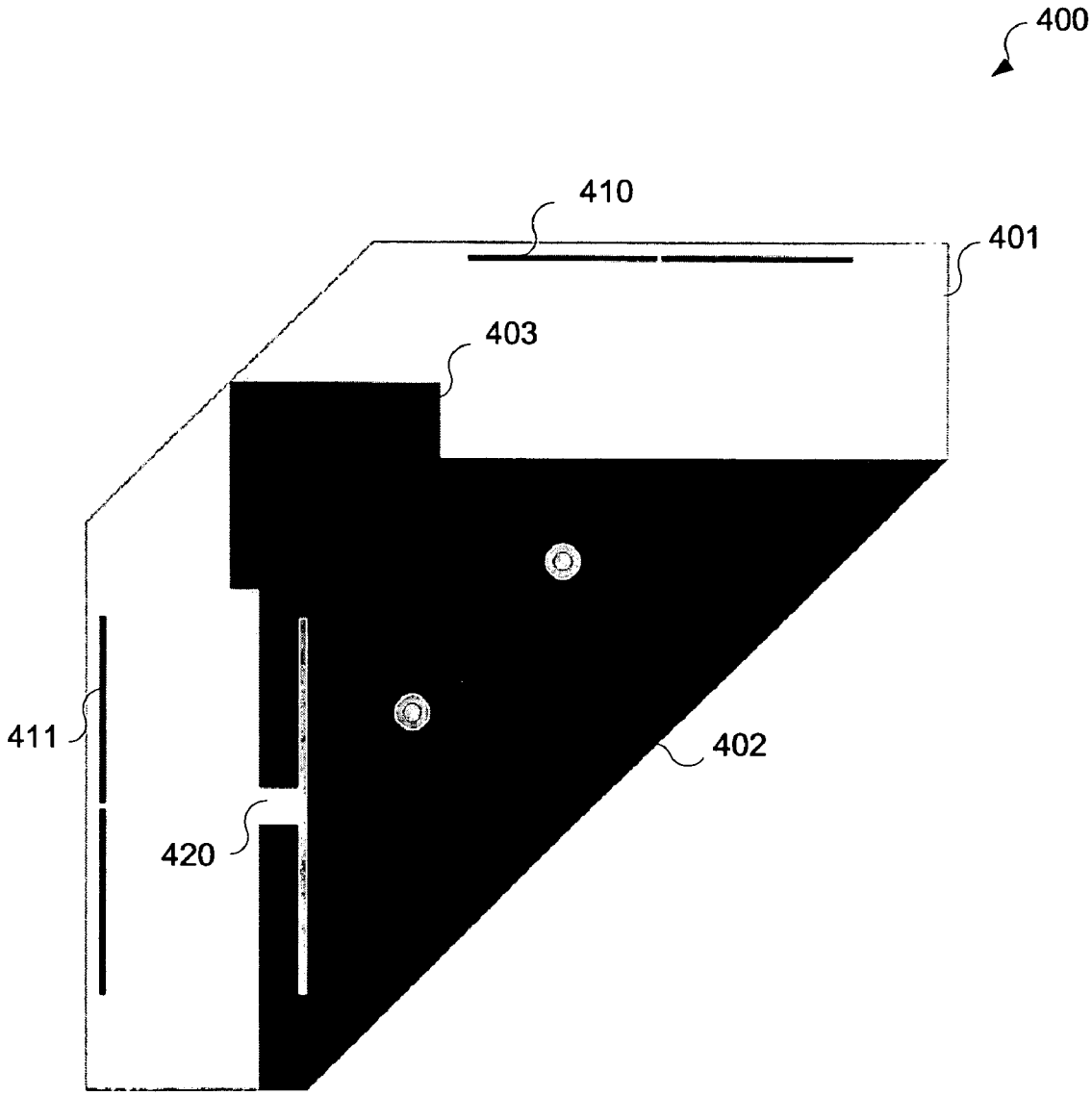
FIG. 4 is a diagram illustrating a top layer of a multi-layer printed circuit board having an orthogonally polarized antenna configuration.

To better appreciate the printed circuit configuration of the closely spaced dipoles, a top layer 400 of an exemplary multi-layer circuit board is shown in FIG. 4. A first printed wiring board layer 401 being a top layer of a multi-layer printed orthogonally polarized antenna configuration includes a ground plane 402 occupying a portion of the first printed wiring board layer 401. A horizontally positioned strip 410 and a vertically positioned strip 411 are portions of the orthogonally positioned printed dipoles. The area of the ground plane with a portion removed shown in a T configuration is a choke 420, which can be used to reduce circulating currents in the ground plane as described above. Further, a rectangular area 403 can be added to the ground plane 402 in order to disrupt circulating current which could radiate and couple energy into dipole feed sections and other sensitive circuits such as amplifier inputs and the like.

Figure 5:
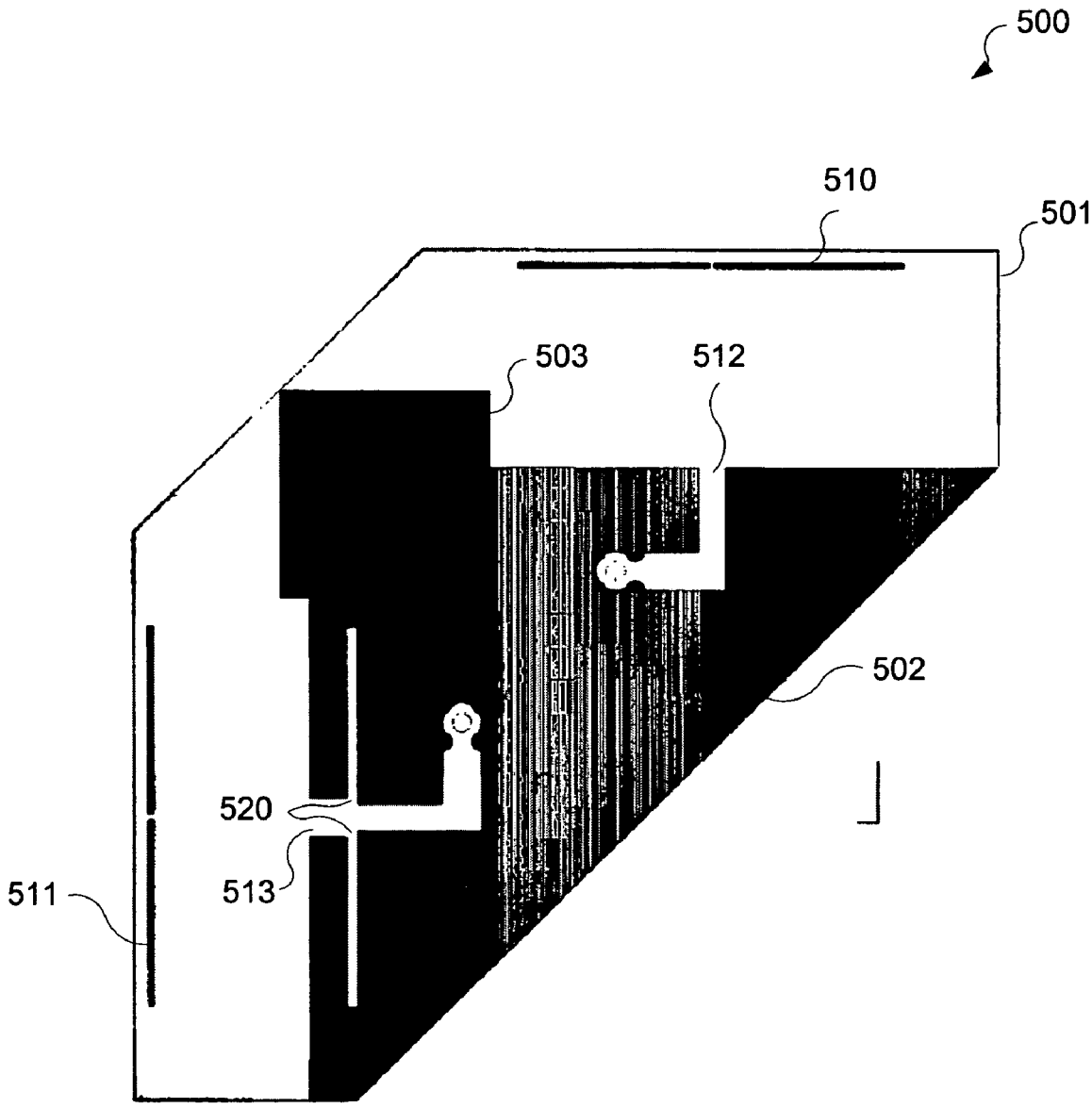
FIG. 5 is a diagram illustrating a second layer of a multi-layer printed circuit board having an orthogonally polarized antenna configuration.

A second layer 500 of a multi-layer printed orthogonally polarized antenna configuration is shown in FIG. 5. A second printed wiring board layer 501 being a second layer of a multi layer printed orthogonally polarized antenna configuration includes a ground plane 502 occupying at least a portion of the second printed wiring board layer 501. A horizontally positioned strip 510 and a vertically positioned strip 511 are portions of the orthogonally positioned printed dipoles. It will be appreciated that the dipole strips 510 and 511 are preferably connected through vias (not shown) to the dipole strips 410 and 411 shown in FIG. 4. A rectangular area 503 can be added to the ground plane 502 in order to disrupt circulating current which could radiate and couple energy into dipole feed sections and other sensitive circuits such as amplifier inputs and the like. It will be appreciated that ground plane 502 further contains a feed channel 512 and a feed channel 513 for providing clear areas for reducing inductance from the ground planes into signal traces in adjacent layers associated with the feed paths that will couple to dipole sections such as the dipole strips 410, 411, 510 and 511. In addition, achoke 520 can be provided corresponding to the choke 420 in the adjacent layer.

Figure 6:
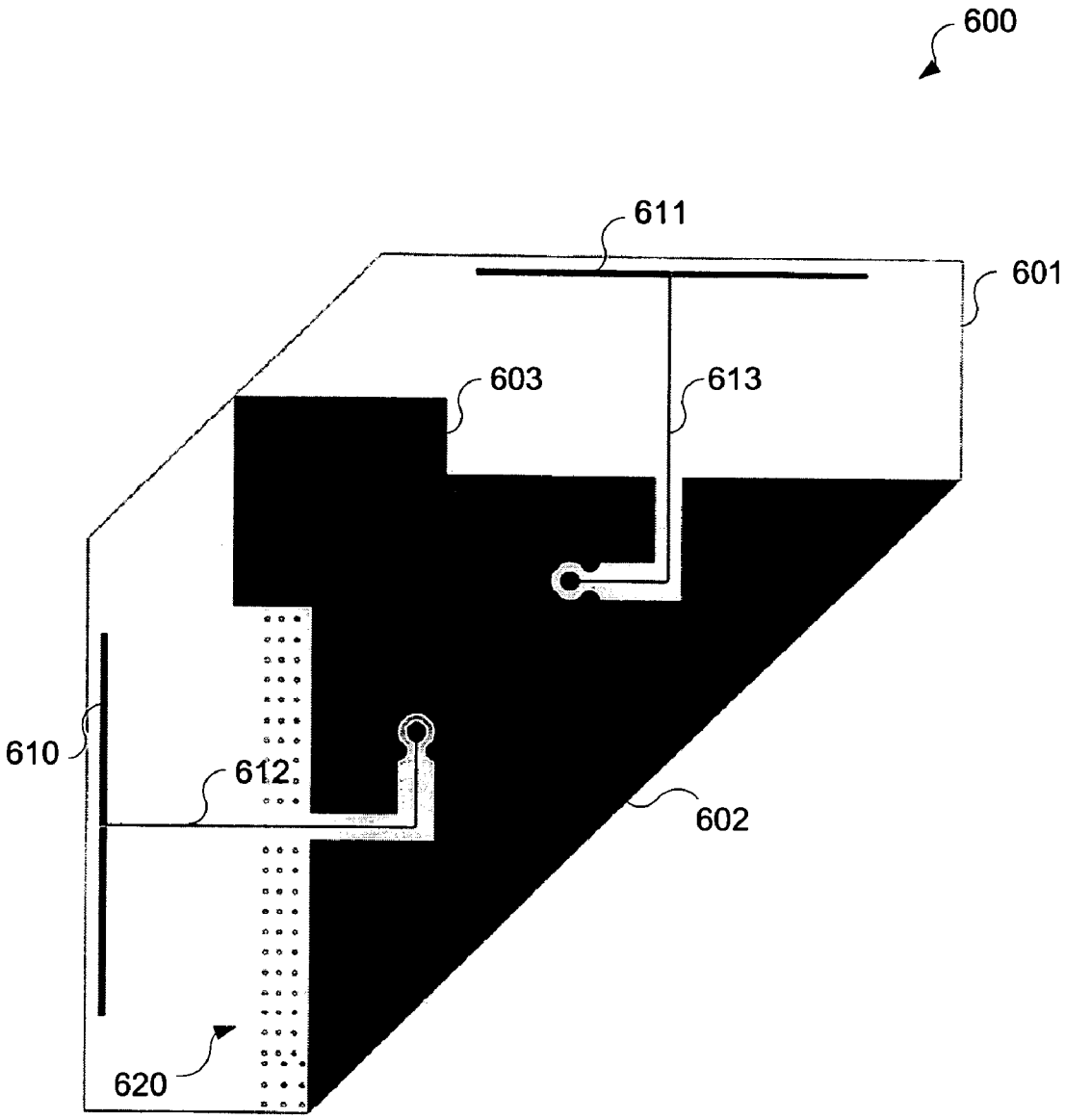
FIG. 6 is a diagram illustrating a third layer of a multi-layer printed circuit board having an orthogonally polarized antenna configuration.

A third layer 600 of a multi-layer printed orthogonally polarized antenna configuration is shown in FIG. 6. A third printed wiring board layer 601 being a third layer of a multi layer printed orthogonally polarized antenna configuration includes a ground plane 602 occupying at least a portion of the third printed wiring board layer 601. It will be appreciated that the dipole strips 610 and 611 are preferably connected through vias (not shown) to the dipole strips 410 and 411 shown in FIG. 4 and to the dipole strips 510 and 511 shown in FIG. 5. A rectangular area 603 can be added to the ground plane 602 in order to disrupt circulating current which could radiate and couple energy into dipole feed sections and other sensitive circuits such as amplifier inputs and the like. As previously noted a first printed dipole antenna, configured with dipole strips 410, 510 and 610 and a second orthogonally positioned printed dipole antenna, configured with dipole strips 411, 511 and 611 are fed, at least in part, through traces 612 and 613 respectively. It can be seen that only one portion of the dipole strips 410, 510 and 610 and 411, 511, 611 are fed by the traces 612 and 613. The other portions are connected to ground as will be described. Signals received and transmitted on first and second printed dipole antennas can be coupled to transceiver input or output circuits (not shown) as appropriate. A connector section 620 is also shown where various connections can be made from traces on the printed wiring board to pins associated with an external connector (not shown) that can be mounted in the area of connector section 620.

Figure 7:
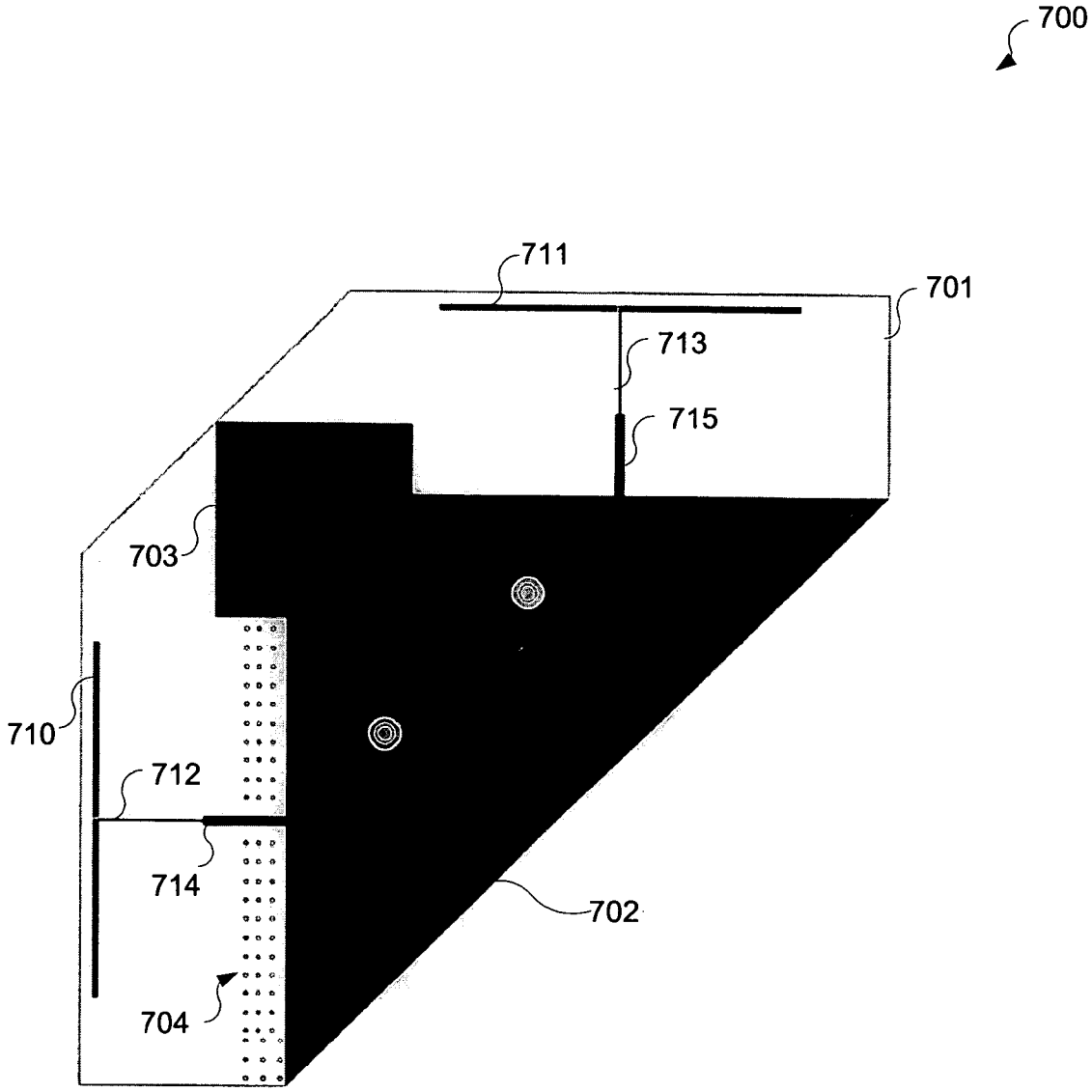
FIG. 7 is a diagram illustrating a fourth layer of a multi-layer printed circuit board having an orthogonally polarized antenna configuration.

A fourth layer 700 of a multi-layer printed orthogonally polarized antenna configuration is shown in FIG. 7. A fourth printed wiring board layer 701 being a fourth layer of a multi layer printed orthogonally polarized antenna configuration includes a ground plane 702 occupying at least a portion of the third printed wiring board layer 701. It will be appreciated that the dipole strips 710 and 711 are preferably connected through vias (not shown) to the dipole strips 410 and 411 shown in FIG. 4, to the dipole strips 510 and 511 shown in FIG. 5, and to the dipole strips 610 and 611 shown in FIG. 6. A rectangular area 703 can be added to the ground plane 702 in order to disrupt circulating current which could radiate and couple energy into dipole feed sections and other sensitive circuits such as amplifier inputs and the like. In a manner similar to the signal portion of the first and second dipoles, for example as described above, a ground portion of the first printed dipole antenna, configured with dipole strips 410, 510, 610 and 710 and the second orthogonally positioned printed dipole antenna, configured with dipole strips 411, 511, 611 and 711 are coupled to ground through traces 712 and 713 respectively. A connector section 720 is also shown where various connections can be made from traces on the printed wiring board to pins associated with an external connector (not shown) that can be mounted in the area of connector section 720. It will also be appreciated that a printed circuit trace for connection to the transceiver through a Marchand Balun can be provided for example, at traces 714 and 715.

Figure 8:
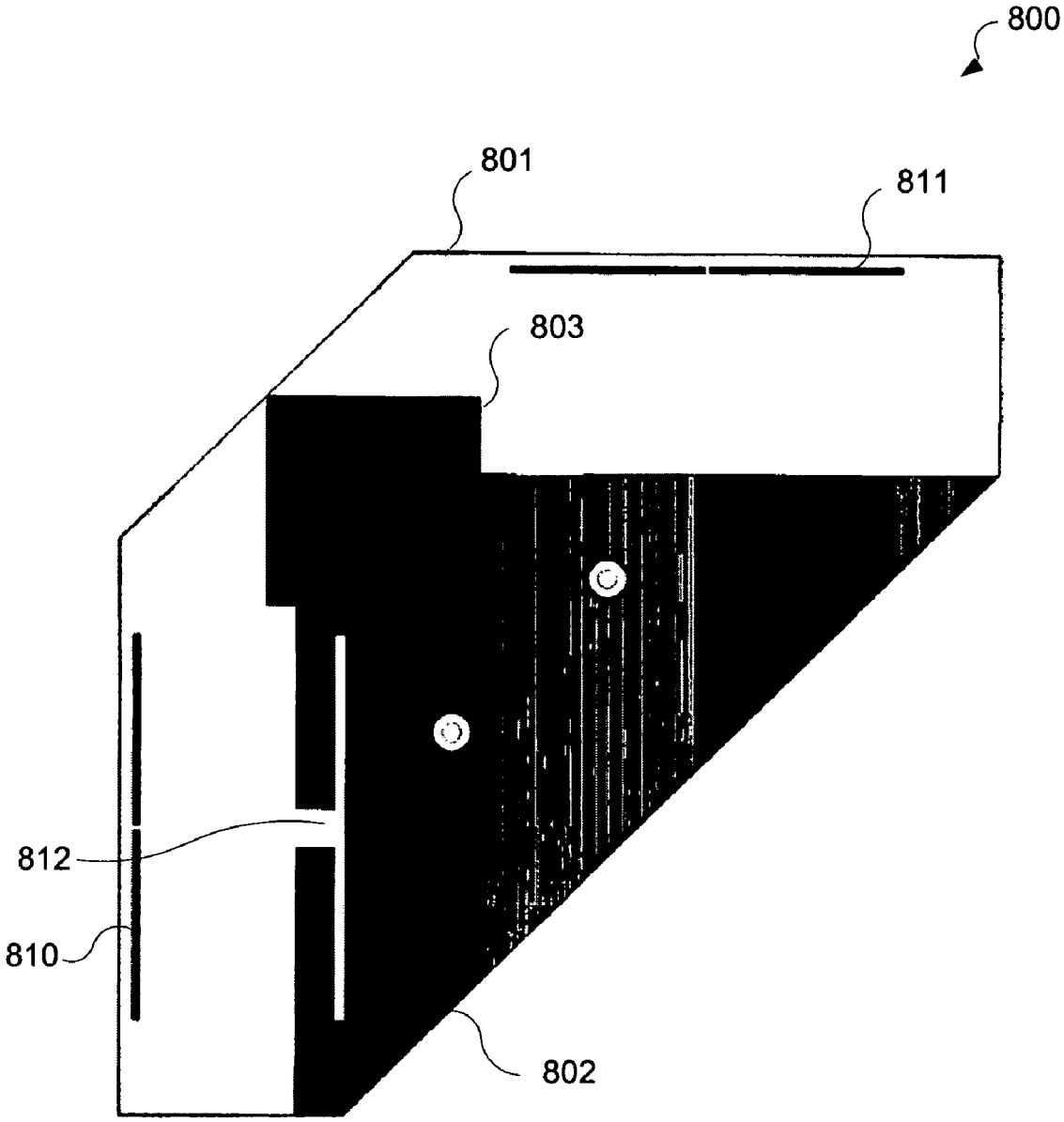
FIG. 8 is a diagram illustrating a fifth layer of a multi-layer printed circuit board having an orthogonally polarized antenna configuration.

A fifth or bottom layer 800 of an exemplary multi-layer circuit board is shown in FIG. 8. A fifth printed wiring board layer 801 being a bottom layer of a multi-layer printed orthogonally polarized antenna configuration includes a ground plane 802 occupying a portion of the fifth printed wiring board layer 801. A horizontally positioned strip 810 and a vertically positioned strip 811 are portions of the orthogonally positioned printed dipoles. The area of the ground plane with a portion removed shown in a T configuration is a choke 820, which can be used to reduce circulating currents in the ground plane as described above. Further, a rectangular area 803 can be added to the ground plane 802 in order to disrupt circulating current which could radiate and couple energy into dipole feed sections and other sensitive circuits such as amplifier inputs and the like.

Figure 9A:
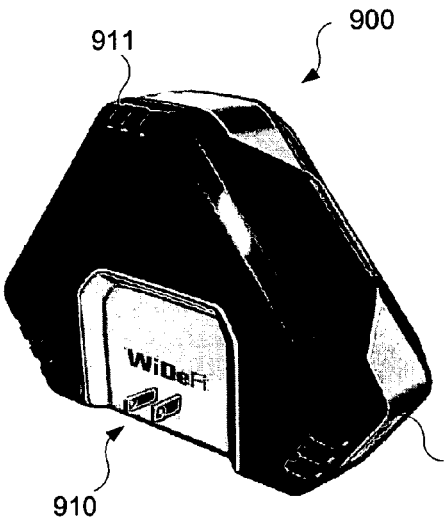
FIG. 9A and FIG. 9B are diagrams illustrating a pair of perspective views of an exemplary embodiment of a packaged antenna configuration of the present invention that is adjustable/rotatable.
Figure 9B:
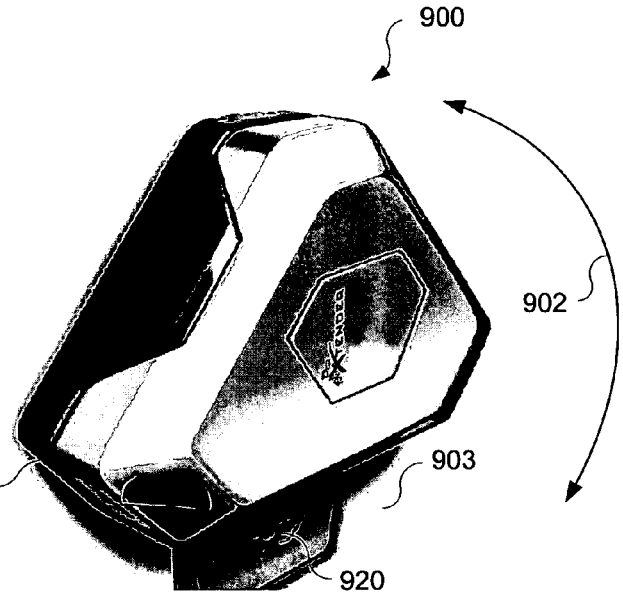

In FIG. 9A and FIG. 9B, perspective views of an exemplary embodiment of a packaged antenna configuration 900 of the present invention are shown. The antenna package 901 is adjustable/rotatable about an axis or hinge which is located in the portion of the package surrounding plug 910 that can be plugged into a standard wall socket 920. Such a configuration provides for potential positioning of the antenna package 901 for placement that reduces or eliminates interference. As depicted, the antenna package 901, which could be associated with a WiDeFi™ TDD repeater, has an align LED 911 at the top of the antenna package 901. Additionally the antenna package 901 can be rotated through an arc 902 such that the top of the antenna package 901 could be rotated down and away from a wall 903. Such rotation would bring the antenna package 901 from a starting position parallel to the wall 903 to a position where one end of the dipole antennas is closer to the wall 903 and the other end is father away from the wall 903, thereby providing a high degree of change in any coupling mechanisms that may be present due to the wall 903. In such a configuration, the LED 911 will flash until the operation of sending and receiving the sounding signal as described above, while repositioning the antenna package 901 results in an acceptable position at which time it will stop, change color, or some other indicia that the interference between the sounding signal transmitter and receiver has been reduced to acceptable levels. When such an indication is provided, the user should stop rotating the antenna package 901.

Figure 10:
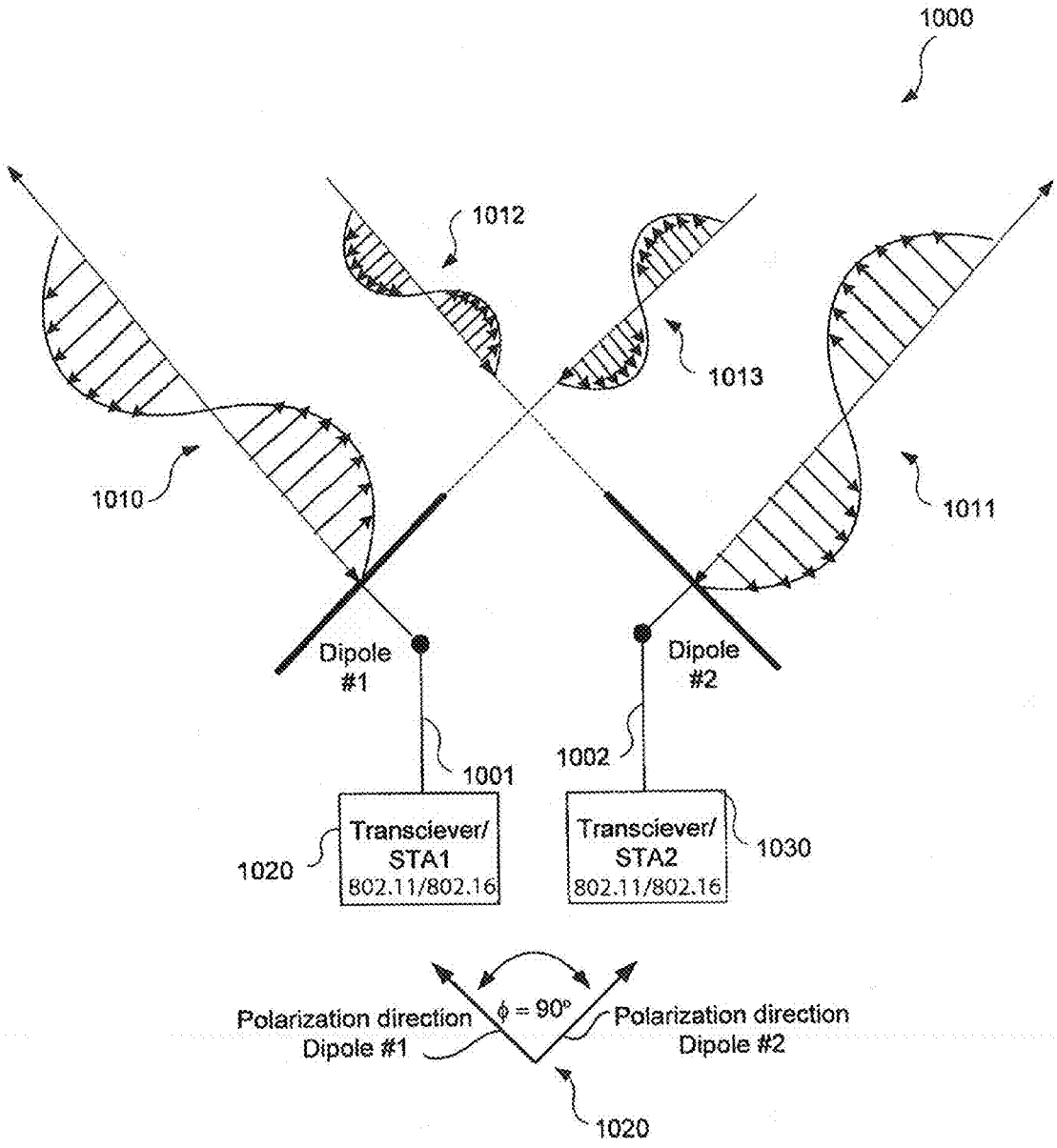
FIG. 10 is a diagram illustrating signals incident on an exemplary embodiment of an orthogonally polarized antenna configuration of the present invention.

By placement of the first and second dipoles in orthogonal relation on a printed wiring board as described and illustrated herein, maximum isolation can be achieved. FIG. 10 shows a configuration 1000 where a first dipole 1001 and a second dipole 1002 are positioned in orthogonal relation, such as a 90° relation 1020, on the surface of a printed wiring board. The first dipole 1001 can transmit signals 1010 with a corresponding polarization and optimally receive signals 1010 with the same polarization. Signals incident on the second dipole 1002 having the polarization of the first dipole 1001, such as incident signal 1012, will not be received, that is, will not effectively couple energy into the second dipole 1002, since the polarization of the second dipole is directed orthogonally away from the polarization direction of the incident signal 1012. Such signal rejection is true of incident signals 1012 incident from remote transmitters and from signal components associated with incident signals 1012 generated by the first dipole 1001. Likewise, the second dipole 1002 can transmit signals 1011 with a corresponding polarization and optimally receive signals 1011 with the same polarization. Signals incident on the first dipole 1001 having the polarization of the second dipole 1002, such as incident signal 1013, will not be received, that is, will not effectively couple energy into the first dipole 1001, since the polarization of the first dipole is directed orthogonally away from the polarization direction of the incident signal 1013. Such signal rejection is true of incident signals 1013 incident from remote transmitters and from signal components associated with incident signals 1013 generated by the second dipole 1002.

It should be noted that the respective first dipole 1001 and the second dipole 1002 can be coupled to a first transceiver/STA 1020 and a second transceiver/STA 1030 for providing a transmit signal and for receiving a signal received on the respective antenna. It will be appreciated that in various exemplary embodiments, the first transceiver/STA 1020 and a second transceiver/STA 1030 can be configured to operate by sending and receiving signals in various modes such as in a TDD mode using one or more frequency channels, in frequency division duplex (FDD) mode and the like, and can be configured to operated according to various standards under 802.11, 802.16, and the like.

The invention is described herein in detail with particular reference to presently preferred embodiments. However, it will be understood that variations and modifications can be effected within the scope and spirit of the invention.

What is claimed is:

1. An antenna configuration for a repeater receiving and re-transmitting a signal, the antenna configuration comprising:

a generally planar shaped multi-layer circuit board;

a first planar antenna printed on at least a first layer of the generally planar multi-layer circuit board, the first planar antenna capable of transmitting and receiving energy associated with a predetermined frequency; and a second planar antenna printed on at least the first layer of the multi-layer circuit board, the second planar antenna capable of transmitting and receiving energy associated with a predetermined frequency, wherein at least the first layer includes a ground plane having a non-symmetrical structure configured to reduce current, and the first planar antenna and the second planar antenna are arranged in a co-planar orthogonal relation to each other.

2. The antenna configuration according to claim 1, wherein the first planar antenna and the second planar antenna include two or more layers of the multi-layer circuit board.

3. The antenna configuration according to claim 1, wherein the first planar antenna and the second planar antenna respectively include a first planar dipole and a second planar dipole.

4. The antenna configuration according to claim 1, further comprising:

a first balun printed on the multi-layer circuit board; and a second balun printed on the multi-layer circuit board;

wherein the first planar antenna and the second planar antenna are coupled to a first transceiver and a second transceiver respectively through the first balun and the second balun.

5. The antenna configuration according to claim 4, further comprising a rotatable packaging structure having an indicator, wherein one of the first and the second transceivers includes a sounding signal transmitter, an other of the first and the second transceivers is capable of receiving the sounding signal and activating the indicator, the rotatable packaging structure is capable of facilitating rotation of the antenna configuration during a transmission of the sounding signal, and the other of the first and the second transceivers is configured to activate the indicator when receiving the sounding signal so as to provide feedback relative to a parameter associated with the sounding signal to enable spatial repositioning of the antenna configuration based on the parameter.

6. The antenna configuration according to claim 1, wherein the non-symmetrical structure configured to reduce current includes a ground structure having non-parallel shapes configured to reduce circulating ground currents in the ground plane.

7. The antenna configuration according to claim 1, wherein the ground plane further includes a printed choke structure including a void, the printed choke structure configured to choke circulating ground currents.

8. The antenna configuration according to claim 1, wherein the repeater includes a time division duplex (TDD) repeater.

9. A time division duplex (TDD) repeater receiving and re-transmitting a signal, the TDD repeater comprising: a generally planar shaped multi-layer circuit board arranged in a plane;

a first transceiver associated with the multi-layer circuit board;

a second transceiver associated with the multi-layer circuit board;

a first planar antenna printed on at least a first layer of the multi-layer circuit board in the plane, the first planar antenna coupled to the first transceiver and capable of radiating and receiving electromagnetic energy associated with a frequency; and a second planar antenna printed on at least the first layer of the multi-layer circuit board in the plane, the second planar antenna coupled to the second transceiver and capable of radiating and receiving energy associated with a frequency, wherein the first planar antenna and the second planar antenna are arranged in co-planar orthogonal relation to each other, and further wherein at least the first layer includes a ground plane having a non-symmetrical structure configured to reduce current.

10. The TDD repeater according to claim 9, wherein the first planar antenna and the second planar antenna include two or more layers of the multi-layer circuit board.

11. The TDD repeater according to claim 9, wherein the first planar antenna and the second planar antenna respectively include a first planar dipole and a second planar dipole.

12. The TDD repeater according to claim 9, further comprising:

a first balun; and a second balun, wherein the first planar antenna and the second planar antenna are coupled to the first transceiver and the second transceiver respectively through the first balun and the second balun.

13. The TDD repeater according to claim 9, wherein the frequency associated with the first transceiver is based upon an 802.11 station (STA) operating on a first frequency channel, and the frequency associated with the second transceiver is based upon an 802.11 STA operating on a second frequency channel.

14. The TDD repeater according to claim 9, wherein the frequency associated with the first transceiver is based upon an 802.16 station (STA) operating on a first frequency channel, and the frequency associated with the second transceiver is based upon an 802.16 STA operating on a second frequency channel.

15. The TDD repeater according to claim 9, wherein the non-symmetrical structure configured to reduce current includes a ground structure having non-parallel shapes configured to reduce circulating ground currents in the ground plane.

16. The TDD repeater according to claim 9, wherein the ground plane further includes a printed choke structure including a void, the printed choke structure configured to choke circulating ground currents.

17. A time division duplex (TDD) repeater receiving and re-transmitting a signal, the TDD repeater comprising:

a generally planar shaped multi-layer circuit board arranged in a plane;

a first transceiver associated with the multi-layer circuit board;

a second transceiver associated with the multi-layer circuit board;

a first planar antenna printed on at least a first layer of the multi-layer circuit board in the plane, the first planar antenna coupled to the first transceiver and capable of radiating and receiving electromagnetic energy associated with a frequency; and a second planar antenna printed on at least the first layer of the multi-layer circuit board in the plane, the second planar antenna coupled to the second transceiver and capable of radiating and receiving energy associated with a frequency, wherein the first planar antenna and the second planar antenna are arranged in co-planar orthogonal relation to each other, and further comprising a rotatable packaging structure having an indicator, wherein:

one of the first and the second transceivers includes a sounding signal transmitter;

an other of the first and the second transceivers is capable of receiving a sounding signal and activating the indicator, the rotatable packaging structure is capable of facilitating rotation of the antenna configuration during a transmission of the sounding signal, and the other of the first and the second transceivers is configured to activate the indicator when receiving the sounding signal so as to provide feedback to a user relative to a parameter associated with the sounding signal to enable spatial repositioning of the antenna configuration based on the parameter.

18. A multi-layer circuit board arrangement in a time division duplex (TDD) repeater capable of receiving and re-transmitting a signal, the multi-layer circuit board arrangement comprising:

a multi-layer circuit board having a ground plane;

a first planar antenna printed on at least a first layer of the multi-layer circuit board in the plane, the first planar antenna capable of radiating and receiving electromagnetic energy associated with a frequency according to a first planar polarization direction; and a second planar antenna printed on at least the first layer of the multi-layer circuit board in the plane, the second planar antenna capable of radiating and receiving energy associated with a frequency according to a second planar polarization direction different from the first planar polarization direction, wherein the first planar polarization direction and the second planar polarization direction are orthogonal to each other, and further wherein at least the first layer includes a ground plane having a non-symmetrical structure configured to reduce current coupled to the ground plane.

19. The multi-layer circuit board arrangement according to claim 18, wherein the first planar antenna and the second planar antenna are closely spaced.

20. The multi-layer circuit board arrangement according to claim 18, wherein the first planar antenna and the second planar antenna include a first planar dipole and a second planar dipole.

21. The multi-layer circuit board arrangement according to claim 18, further comprising:

a first balun printed on the multi-layer circuit board; and a second balun printed on the multi-layer circuit board, wherein the first planar antenna and the second planar antenna are coupled to a first transceiver and a second transceiver respectively through the first balun and the second balun.

22. The multi-layer circuit board arrangement according to claim 21, wherein the first balun and the second balun are printed on at least one layer of the multi-layer circuit board.

23. The multi-layer circuit board arrangement according to claim 18, wherein the non-symmetrical structure configured to reduce current includes a ground structure having non-parallel shapes configured to reduce circulating ground currents in the ground plane.

24. The multi-layer circuit board arrangement according to claim 18, wherein the ground plane further includes a printed choke structure including a void, the printed choke structure configured to choke circulating ground currents.

* * * * *